US006871762B1

(12) United States Patent
Cripps

(10) Patent No.: US 6,871,762 B1
(45) Date of Patent: Mar. 29, 2005

(54) DISPENSER FOR ICE-THAWING AND OTHER GRANULATED MATERIALS

(76) Inventor: Paul E. Cripps, P.O. Box 140017, Boise, ID (US) 83714

( * ) Notice: Subject to any disclaimer, the term of this patent is extended or adjusted under 35 U.S.C. 154(b) by 0 days.

(21) Appl. No.: 09/203,952

(22) Filed: Dec. 1, 1998

Related U.S. Application Data

(60) Provisional application No. 60/067,802, filed on Dec. 3, 1997.

(51) Int. Cl.[7] ..... B67D 5/06

(52) U.S. Cl. ..... 222/142.3; 222/179.5; 222/368; 141/231; 141/358

(58) Field of Search ..... 222/135, 142.3, 222/179.5, 368; 141/231, 22, 21, 380, 358; 239/152, 154

(56) References Cited

U.S. PATENT DOCUMENTS

| | | | | |
|---|---|---|---|---|
| 1,659,065 A | * | 2/1928 | Weigand | 141/358 |
| 2,083,135 A | * | 6/1937 | Agerell et al. | 141/380 |
| 2,604,235 A | * | 7/1952 | Teston | 222/179.5 |
| 2,723,053 A | | 11/1955 | Gamrud | 222/177 |
| 3,118,575 A | | 1/1964 | McComley | 222/168 |
| 3,756,509 A | | 9/1973 | Hamnes | 239/675 |
| 3,966,124 A | | 6/1976 | Sukup | 239/666 |
| 4,027,788 A | | 6/1977 | Parker et al. | 222/614 |
| 4,442,979 A | | 4/1984 | Kiipper | 239/656 |
| 4,562,941 A | | 1/1986 | Sanfilippo | 222/143 |
| 4,658,992 A | | 4/1987 | Peleus | 222/199 |
| 4,718,578 A | | 1/1988 | Radek et al. | 222/108 |
| 4,823,993 A | | 4/1989 | Siegel | 222/345 |
| 5,018,669 A | | 5/1991 | vanderlely | 239/665 |
| 5,833,097 A | * | 11/1998 | Ruth | 222/368 |
| 5,833,287 A | * | 11/1998 | Shade | 141/231 X |

* cited by examiner

*Primary Examiner*—Joseph A. Kaufman
(74) *Attorney, Agent, or Firm*—Paul Cripps; Richard Speth; Dwayne Cripps

(57) ABSTRACT

A container for storage, dispensing, and spreading of ice-thawing materials for use around doorways, walkways, and other entrances where people walk and ice can form. It includes a storage hopper safe from the weather elements, a rotary dispenser drum which dispenses a pre-measured amount of ice-melt material or other granulate such as sand to a spreader try which can be removed and used to spread material where needed. The storage hopper has a discharge hole in the base that matches the hole in the rotary drum dispenser. The drum dispenser is a hollow drum suspended in air where the hole meets the hole in the hopper. The drum is secured in place by the ends which protrude through either the outside of the hopper wall or the unit container wall, the drum can be rotated manually or mechanically to place the hole either on top for filling of tube or on the bottom for discharging the materials from the tube. The spreading tray has a fill area to receive the material from the tube and a sifter area for dispersing the material, the tray can be removed by use of the handle and replaced to refill by rotating drum hole back to top position and then back to bottom position.

8 Claims, 5 Drawing Sheets

DISPENSER FOR ICE-THAWING AND OTHER GRANULATED MATERIALS

CROSS REFERENCE TO RELATED APPLICATIONS

Figure 1:
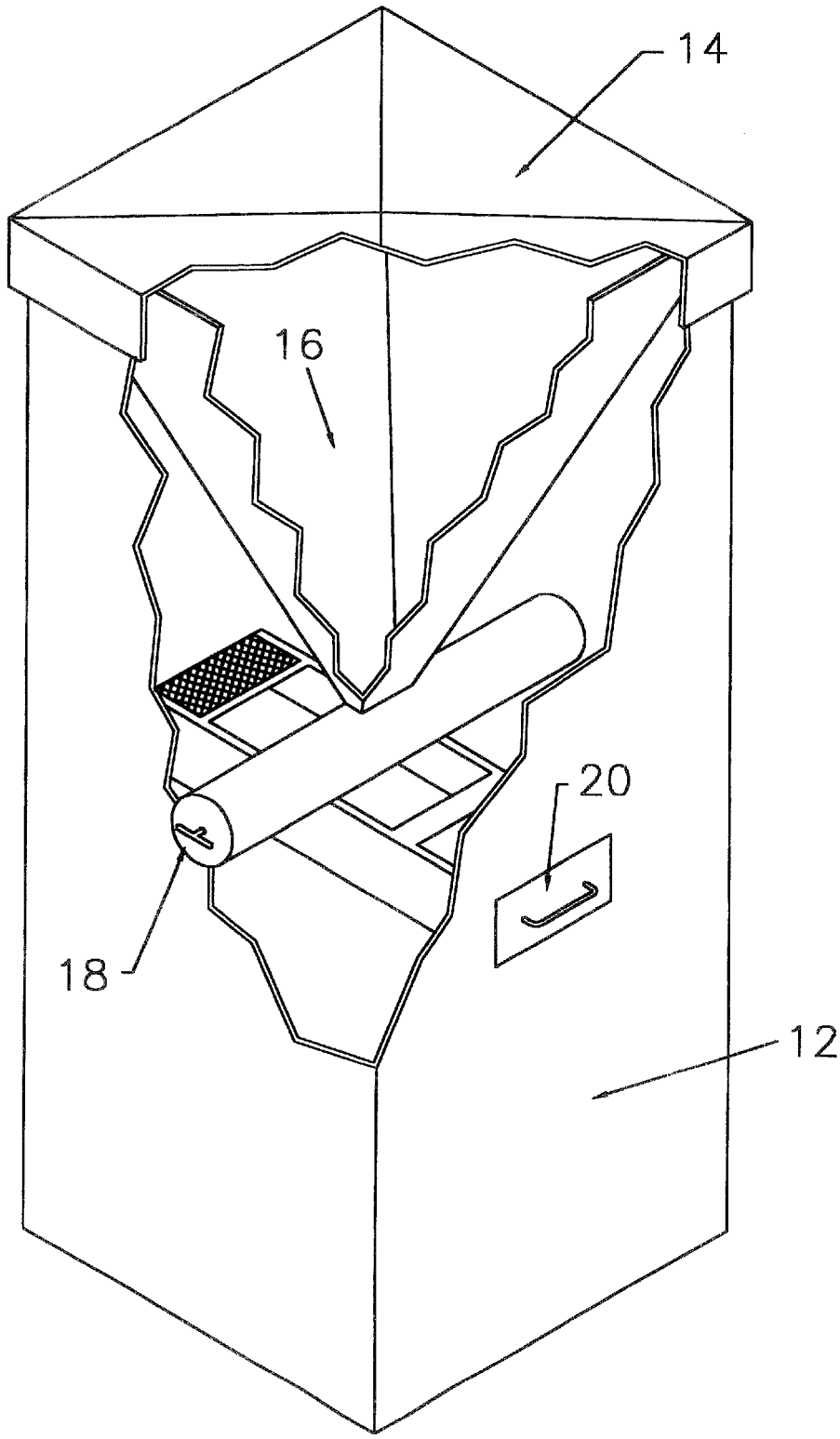

This Application claims the benefits of Provisional Application No. 60/067,802 filed Dec. 3 1997, now abandoned.

FIELD OF THE INVENTION

This invention relates to storage, controlled dispensing, and spreading of granular substances such as Ice-Thawing materials Discussion of Prior Art The need was noted as a result of doing snow removal and spreading de-icer on icy areas for small businesses. Often it could be seen where the business owner had attempted to spread de-icer around their doorways and entrances. The business owners spread the de-icer because of personal liability if someone slipped on their ice. They said that it was very cumbersome to use and that there was no place to store the de-icer boxes so the material did not get wet. They also complained that the 60 LB boxes of de-icer was to heavy to move each time they needed it. Also, the Ice-thawing material is caustic to the skin and stains clothing.

A container was designed that could be located right in the area where the de-icer was needed and that had an easy to use dispenser that measures out the proper amount of de-icer each time and a spreader that is easily used by hand to spread the ice-thawing material where it was needed.

A Spreader for solid and liquid thawing materials, U.S. Pat. No. 3,035,360 to Kiipper is a motor driven spreader for use on vehicles which would not work for use on sidewalks and doorways. Various forms of dispensers have been devised to dispense controlled flows of granulate and bulk produce. For example U.S. Pat. Nos. 4,562,941, 4,658,992, and 4,823,993 all control the flow of granulate materials but do not give a measured amount and only when needed. Spreaders for seed, fertilizers and granulate materials such as U.S. Pat. Nos. 3,966,124, 3,756,509, 4,027,778, and 5,018,669 are all for use over large areas and do not lend themselves to small areas such as doorways and alcoves. Also, the personnel doing the spreading would normally be the first individuals to arrive at the place of business each day and would not be the type of person to use the heavy complicated spreaders.

All of the spreaders and dispensers use metal hoppers which are subject to condensation. When moisture gets into most granulate materials and especially ice-thawing materials, the material clump and will not readily go through the dispenser mechanism.

OBJECTS AND ADVANTAGES

Besides being the only device 1 could locate that addressed the needs for storing, dispensing, or spreading ice-thawing materials for this particular application, several objects and advantages of the present invention are:

(a) To reduce safety problems by having an Ice-melt material Dispenser that is located in the area where it is needed, thereby, allowing ice to be thawed before it becomes a hazard.

(b) To provide a hand-held spreader which can easily be used even by personnel in business attire to spread the Ice-thawing material where it is needed without soiling hands or clothing.

(c) To provide an Ice-melt material Dispenser completely made out of plastic such as polypropylene which considerably reduces condensation, allowing storage of large amounts of material without fear of clumping.

(d) To Provide an Ice-melt material Dispenser completely made out of plastic such as polypropylene which also considerably reduces the amount of maintenance required by devices made of metal such as painting and rust repair.

(e) To provide a dispenser mechanism that delivers a pre-measured amount of granulate material so that the spreader is not overfilled which prevents wasted material and cleanup problems.

Further Objects and Advantages are to provide a dispenser mechanism that does not bind up from granulate material being wedged in the movable parts. The only movable part of the dispenser is the cylindrical measuring drum that is securely suspended in air at the loading and unloading areas thereby allowing the occasional loose granulate to fall into the spreader rather than being ground between the wall and the moving parts as in other dispensers. Also, being made of plastic which is somewhat flexible, allows any granulate which happens to get caught between dispenser drum and hopper opening blades to roll past and into the spreader container.

DRAWING FIGURES

In the Figures, minor non-consequential pieces are omitted to better show the major components and how they work.

FIG. 1 show how the 5 major parts fit in general relationship to each other

Figure 2:
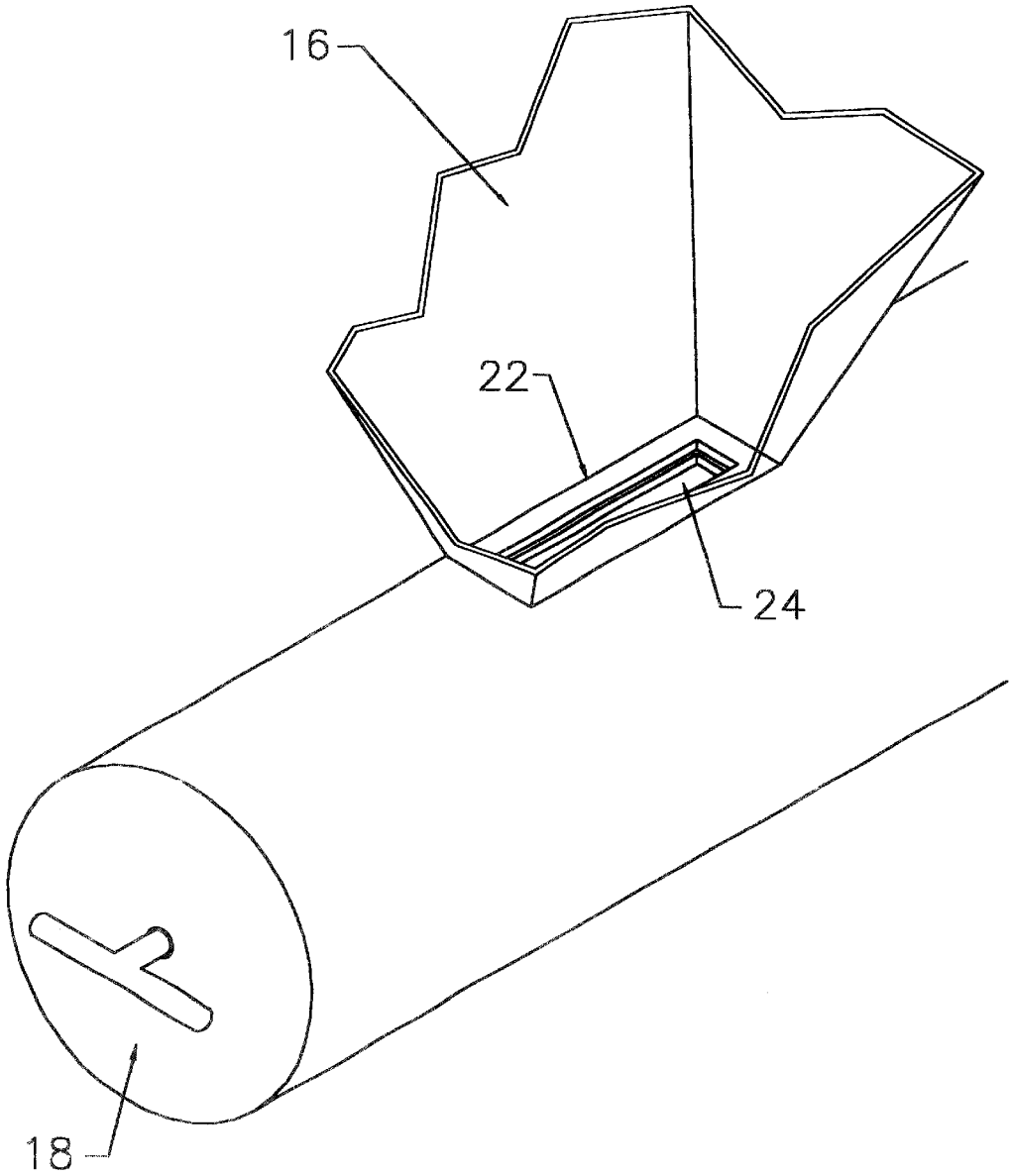
Figure 3:
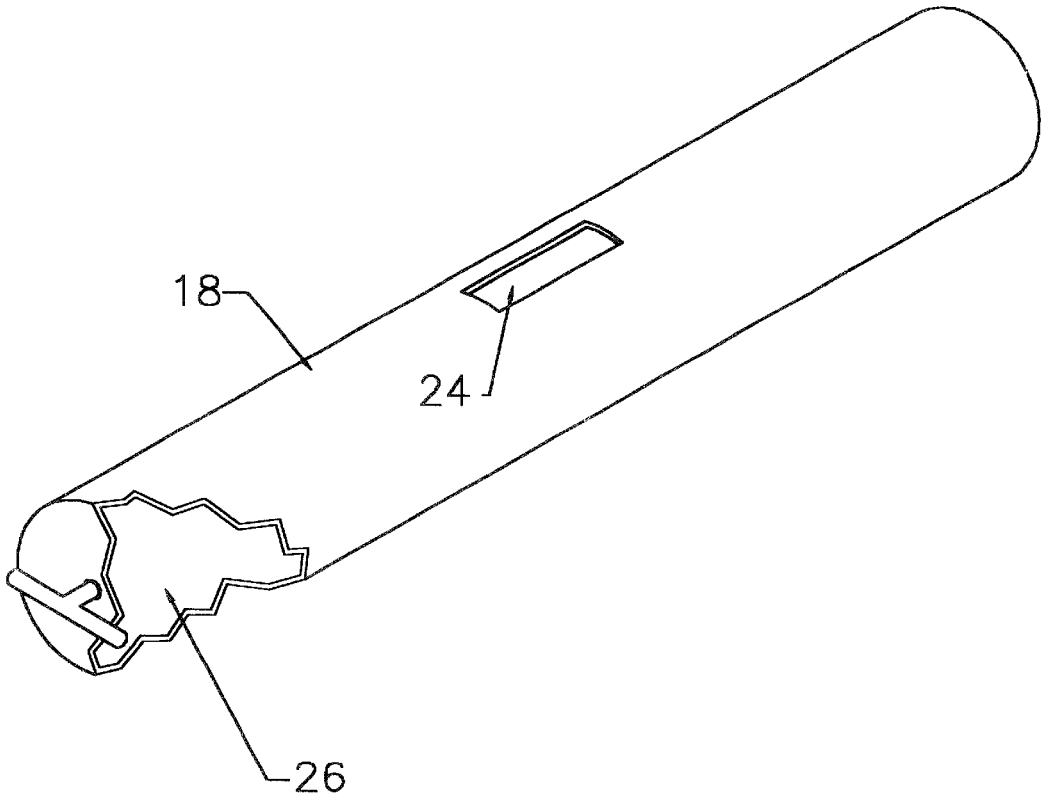
Figure 4:
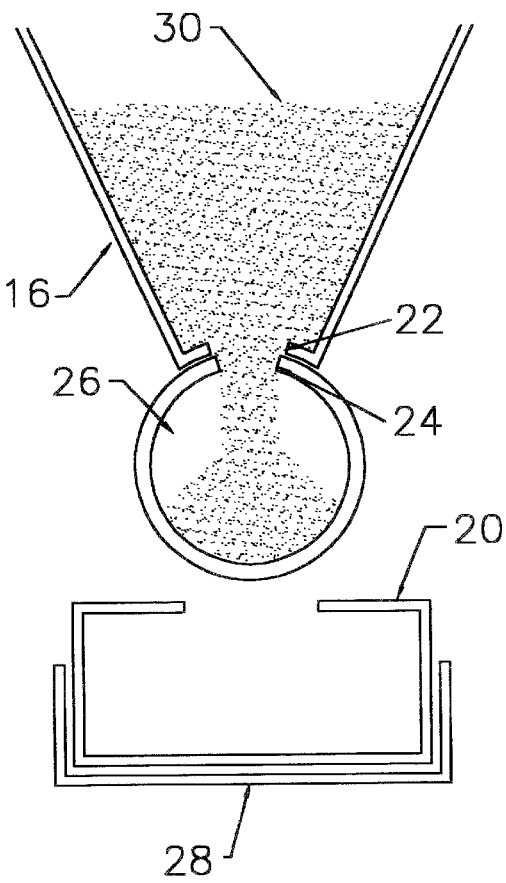
Figure 5:
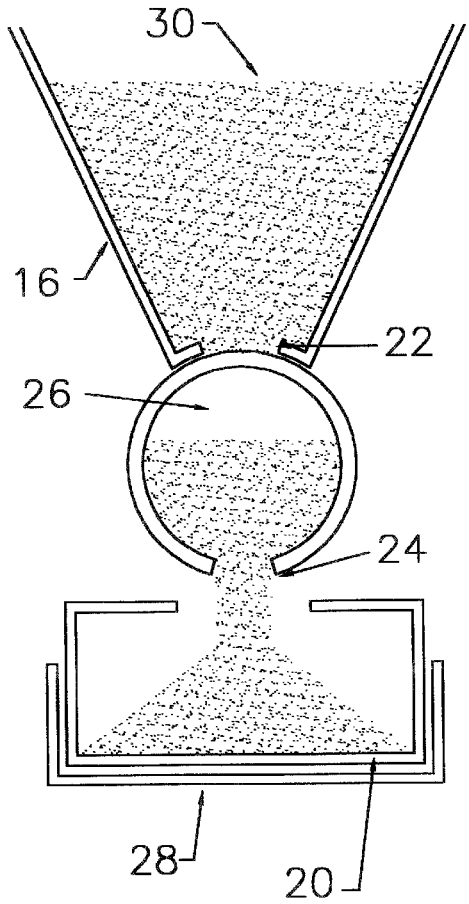
Figure 6:
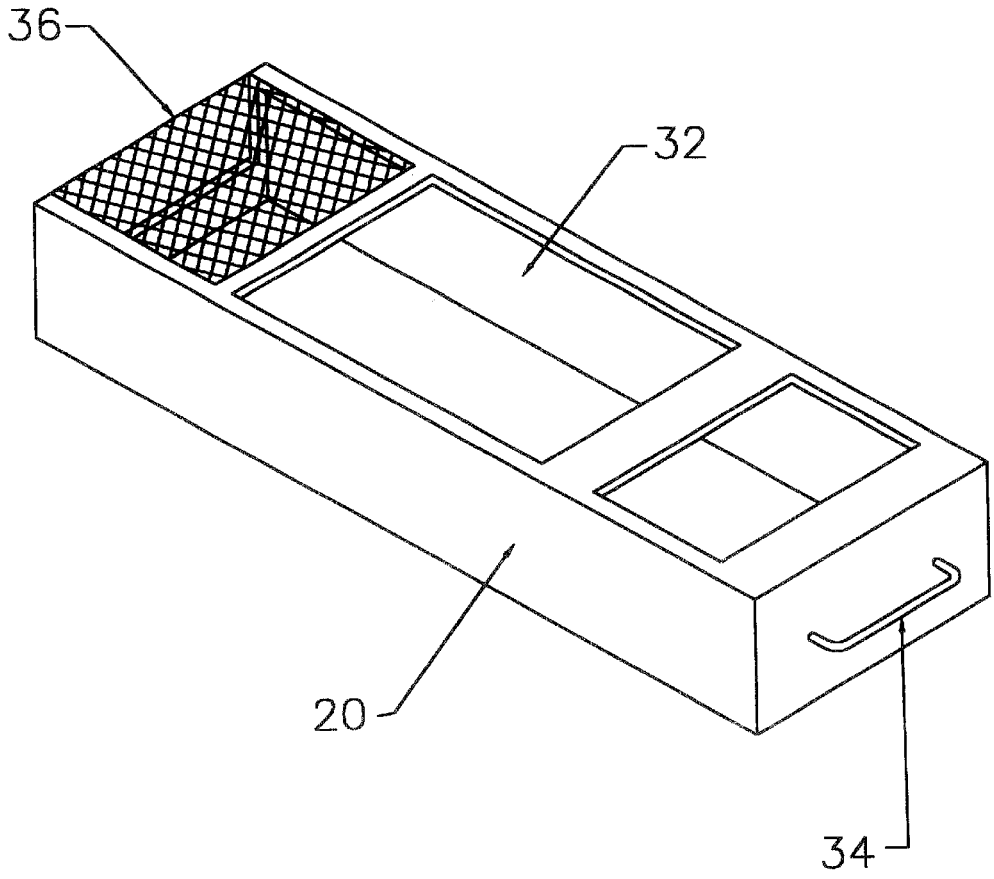

FIG. 2 show the filler opening in the base of the hopper and the opening in the rotatable Dispenser Drum FIG. 3 shows the hollow rotatable Dispenser drum with the filler opening FIG. 4 shows the Dispenser Drum being filled with granulate from the hopper when the Dispenser Drum opening is lined up with the hopper opening FIG. 5 show the Spreader tray being filled when the Dispenser Drum is rotated so the Dispenser Drum Opening is on the Bottom FIG. 6 shows the Spreader Tray with the loading area and the sifter area for dispersing granulate when being used to spread material in desired areas.

REFERENCE NUMERALS IN DRAWINGS

| | |
|---|---|
| | 12 Dispenser container |
| 14 Lid | 16 Hopper |
| 18 Dispenser Drum | 20 Spreader Tray |
| 22 Hopper Dispensing Opening | 24 Dispenser Drum Opening |
| 26 Dispenser Drum Interior | 28 Spreader Tray Guide |
| 30 Granulate Material | 32 Spreader Tray Loading Area |
| 34 Spreader Tray Handle | 36 Spreader Tray Sifting Area |

SUMMARY

In Accordance with the described invention a dispenser for ice-thawing material to be spread in small local areas consists of a hopper for storage of the material, a dispenser to dispense out a pre-determined amount of ice-melt material, and a spreader tray to allow a person to spread material over desired area without getting the material on their hands or clothing.

DISCRIPTION & OPERATION—FIGS. 1 TO 6

A typical embodiment of the invention illustrated in FIG. 1 would consist of a plastic container 12 to house the various components of the despenser with a plastic lid 14 to protect a hopper 16 from the elements. The lid 14 would fit over the edges of the container and would have a slightly domed top to facilitate the run-off of rain and snow. The hopper 16 would have an opening 22 in the bottom large enough to allow a granulate material 30 to flow freely. A Dispensing Drum 18 directly under the hopper 16 would be tight against hopper opening 22 to prevent granulate flow unless desired. A spreader Tray 20 under the Dispenser Drum 18 would catch the granulate when allowed to flow. (Note: a spreader tray guide 28 was not shown to simplify FIG. 1. The guide holes through which the Dispenser Drum 18 is inserted and which acts as a bearing is also not shown.) All of the parts of the invention illustrated in FIG. 1 are constructed of polypropylene but could be constructed of several other types of material or plastics.

The illustration in FIG. 2 shows the alignment of the hopper opening 22 and the dispenser drum opening 24 when in the up position. The granulate would freely flow between the two openings until the hollow Dispensing Drum 18 as depicted in FIG. 3 was filled.

The cross-section in FIGS. 4 & 5 show the relative positions of the hopper opening, the dispensing drum 18 and drum opening 24 with the spreader tray 20 directly below. FIG. 4 shows dispenser drum opening 24 in the up position which allows the granulate from the hopper 16 to flow into the drum 18. The drum opening 24 in FIG. 5 has been rotated to the down position allowing the granulate in the drum 18 to flow into the spreader tray 20. The flow of granulate in the hopper 16 is stopped by the surface of the dispenser drum 18. The size of the openings in the hopper and drum and the diameter of the Dispenser drum 18 determine the amount of granulate transferred.

The spreader tray 20 illustrated in FIG. 6 is small enough to be easily handled by one person. When the tray 20 has been filled as shown in FIG. 5, it can be pulled out of the dispenser container 12 by the handle 34 and with the tray 20 in the vertical position, the granulate can easily be dispersed where needed simply by holding the tray 20 over the desired area and gently shaking the tray 20 by the handle 34. When the Tray 20 has been emptied, it can quickly be refilled by placing the tray 20 back in the container 12 and rotating the dispenser drum opening 24 first to the to top and then to the bottom. The spreader tray 20 is now ready to use again.

CONCLUSIONS

A person can see that the dispenser for granulate ice-melt materials which can hold a large amount of material, easily dispense the proper amount of material, and allow a person to quickly and easily spread the ice-melt where needed goes a long way to reduce the safety hazard of dangerous ice in the walkways. Furthermore, this Dispenser has the following additional advantages:

It is comprised of a plastic material which does not cause condensation as does metal. This greatly reduces the clumping problem with the granulate material.

The plastic material greatly reduces the maintenance as required by metal apparatuses.

Although the descriptions listed previously contains some specificities, these should not be construed as limiting the scope of the invention but merely providing illustrations of some of the presently preferred embodiments if this invention. For example the enclosure could have a different shape or be a wall mounted rather than free standing. The hopper could be part of the enclosure as opposed to a separate part.

Thus the scope of the invention should be determined by the appended claims and their legal equivalents, rather than by the examples given.

What is claimed is:

1. A system for storing, dispensing and dispersing granular ice thawing material comprising:

a) a dispenser container comprising;

(i) a system housing unit having weather-proof sidewalls and bottom; housing a material transfer area;

(ii) a hopper for storing granular ice thawing material, with an outlet positioned at the bottom of said hopper, allowing said granular ice thawing material to exit through said outlet by gravity feed;

(iii) a spreader tray guide positioned in said material transfer area and below said hopper;

(b) a weather-proof lid covering said hopper, with a peaked top to allow moisture run-off;

(c) a removable spreader tray comprising;

(i) a container sized to fit within the said spreader tray guide;

(ii) a spreading tray sifting area located at one end, covered with a mesh screen, with a sieve size to allow said granular ice thawing material to disperse at a regulated rate when said spreader tray is removed from said dispenser container and is gently shaken over area where said granulated ice melting material is required;

(iii) a spreader tray loading area, located on top of said container, large enough to accept said ice thawing material without undue spillage;

(iv) a handle located at opposite end of said container from said spreader tray sifting area, used for inserting or removing of said spreader tray from said dispenser container, and for holding said spreader tray while dispersing said granular ice melting material over walk areas where desired (d) a dispenser drum for transferring said granular ice thawing material from said hopper outlet to said spreader tray, said dispenser drum comprising;

(i) a rotatably mounted hollow cylinder, positioned directly below said hopper, and above said spreader tray and, (ii) with a dispenser drum opening matching a size of said hopper outlet, and wherein said dispenser drum is in a loading position, the said dispenser drum opening is aligned with said hopper outlet, allowing said granular ice melting material to gravity feed into said dispenser drum until said dispenser drum is full, and wherein said dispenser drum is in an unloading position, the said dispenser drum opening is aligned with said spreader tray loading area, allowing said granular ice melting material to gravity feed into said spreader tray until said dispenser drum is empty.

2. A system of claim 1 wherein said hopper will hold said ice melting material or other granulated materials.

3. A system of claim 1 wherein said spreader tray, when loaded with said ice melting material, can be removed from said dispenser container, and by holding said handle, can disperse said granular ice melting material through said spreader tray sifting area to ice covered sidewalks, driveways, entryways or other ice covered walkways.

4. A system of claim 2, wherein side of said hopper are sloped as to allow said granular ice melting material to flow freely down to said hopper outlet.

5. A system of claim 1, wherein the said dispenser drum has stop tabs located as to stop and align said dispenser drum opening with said hopper outlet when in the load position and to stop and align said dispenser drum opening to stop and align with said spreader tray loading area on said spreader tray when in unloading position.

6. A system of claim 1, wherein the said dispenser drum is in the loading position, the edges of the said dispenser drum opening are aligned with and tight against the edges of the said hopper outlet allowing said granular ice melting material to flow freely into said dispenser drum, but preventing said granular ice melting material from spilling out.

7. A system of claim 2, wherein the said spreader try opening of the said spreader tray is larger than the diameter of said dispenser drum and positioned as to catch any said granular ice melting material that may fall during rotation of said dispenser drum.

8. A system of claim 1, wherein as the said dispenser drum is rotated to the unload position, and when said granular ice melting material gets between the said dispenser drum and the edges of the said hopper outlet, the said granular ice melting material will roll past the edges of the hopper opening, due to the narrow contact area between the said dispenser drum and the said hopper outlet, and will roll over said dispenser drum into said spreader tray.

* * * * *